US006289523B1

(12) United States Patent
Chiang

(10) Patent No.: US 6,289,523 B1
(45) Date of Patent: Sep. 18, 2001

(54) SWIMMING GOGGLES

(76) Inventor: Herman Chiang, 2 Fino.-634-9, Ching-Ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 09/438,699

(22) Filed: Nov. 11, 1999

(51) Int. Cl.[7] ..... A61F 9/02
(52) U.S. Cl. ..... 2/428; 2/445
(58) Field of Search ..... 2/428, 429, 439, 2/445, 452, 426, 440

(56) References Cited

U.S. PATENT DOCUMENTS 5,524,300 * 6/1996 Chiang ..... 2/439
5,581,822 * 12/1996 Tagyo ..... 2/428
5,631,716 * 5/1997 Chao ..... 351/41
5,734,995 * 4/1998 Chiang ..... 2/428
5,802,620 * 9/1998 Chiang ..... 2/428
6,052,834 * 4/2000 Chou ..... 2/428

FOREIGN PATENT DOCUMENTS

2688322 * 12/1992 (FR) ..... 2/426

* cited by examiner

*Primary Examiner*—John J. Calvert
*Assistant Examiner*—Katherine Moran
(74) *Attorney, Agent, or Firm*—Pro-Techtor International Services

(57) ABSTRACT

The subject invention relates to the presentation of structural improvement of swimming goggles. This comprises of two frames, two tenses contained on the two frames, a nose bridge joining the two frames, and a headset fitted to the outside of the two frames. It is characterized in that: the nose bridge comprises of a connecting unit and a combining unit, with soft material fitted to one side where the connecting unit is in contact with the nose bridge; and, the combining unit is located at two sides of the connecting unit, whereby the soft material will provide comfortable contact with the nose when the swimming goggles are worn by the user.

14 Claims, 7 Drawing Sheets

SWIMMING GOGGLES

BACKGROUND OF THE INVENTION

The subject invention relates to a type of swimming goggles, particularly to a structural improvement of swimming goggles involving a nose bridge that is equipped with a soft protective pad, providing comfortable contact with the user's nose.

Conventionally, the construction of swimming goggles involved lens frames, lenses, a nose bridge, a protective pad, and a headset. Wherein the nose bridge serves to join the lens frames, the headset is fastened onto the user's head; while the protective pad, which is resistant to water seepage, provides comfortable contact with the user's face. Different users have different face shapes and different distances between their eyes, though comfortable contact can be achieved by adjusting the nose bridge and the tension of the headset. The protective pad for better fitting with the user's face and the nose bridge in contact with the user's nose, also play important roles to the comfort of fit when the user is wearing swimming goggles. The prior design of swimming goggles involved a protective pad, either of a sucking disc type or a foam sponge type, which did not have the same tight fitting and comfort to the user's face, but since they are both of soft materials, they can be accepted by consumers. However, a nose bridge serves simultaneously with the function of joining two lens frames, so it is often made of a hard material, resulting in an uncomfortable feeling of poor contact with the nose ridge. Please refer to FIG. 1 for illustration of the nose bridge 50 on conventional swimming goggles 5 being made of a hard material in the joining of lens frames 51 and 52 on two sides. When the goggles are worn on the user's face, as shown in FIG. 2, the hard material of the nose bridge 50 will roughly contact the nose ridge 60, so the comfort level when wearing the goggles may not be very high.

BRIEF DESCRIPTION OF THE INVENTION

The primary objective of this invention—the swimming goggles—is to provide a type of swimming goggle which includes a nose bridge of a soft protective pad on one side of the nose bridge, which is in contact with the user's nose ridge, being of a soft material. This will provide comfortable contact on the user's nose ridge.

The subject invention, the structural improvement of the swimming goggles, is characterized in that: the said nose bridge comprises of a connecting unit and a combining unit, wherein on one side of the connecting unit is in contact with the nose ridge, and is fitted with a soft material, thus providing comfortable contact with the user's nose ridge.

Based on the main characteristics described above, the soft material fitted on the connecting unit is either foam sponge, rubber, plastic or thermoplastic rubber. The combining unit can be either a one-piece design, or fastened to the lens frames of the swimming goggles.

BRIEF DESCRIPTION OF DIAGRAMS

DETAILED DESCRIPTION OF THE PREFERRED EMBODIMENT

Figure 1:
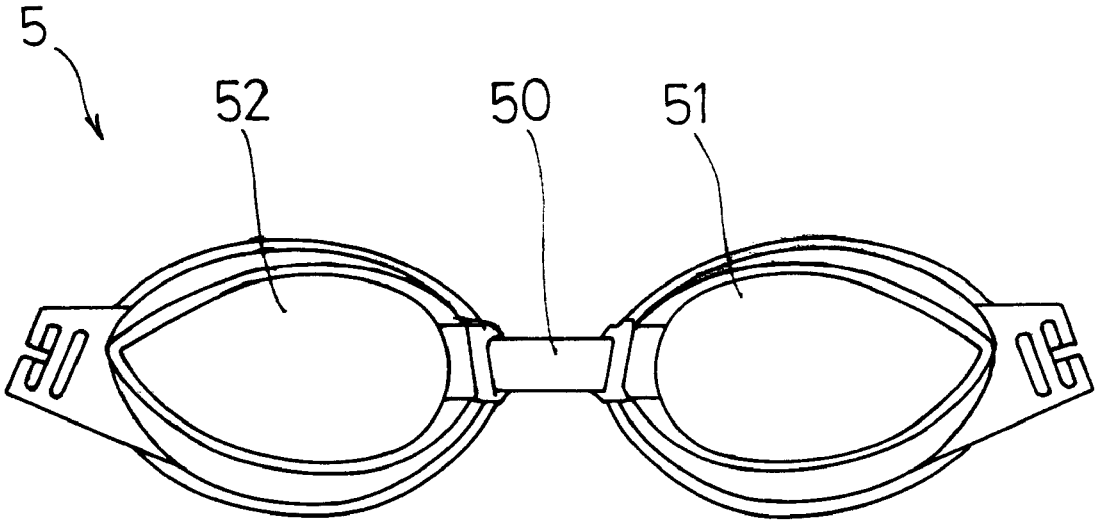
FIGS. 1 and 2 are a plan view of a prior design of swimming goggles and a side view of the goggles worn on a user.
Figure 2:
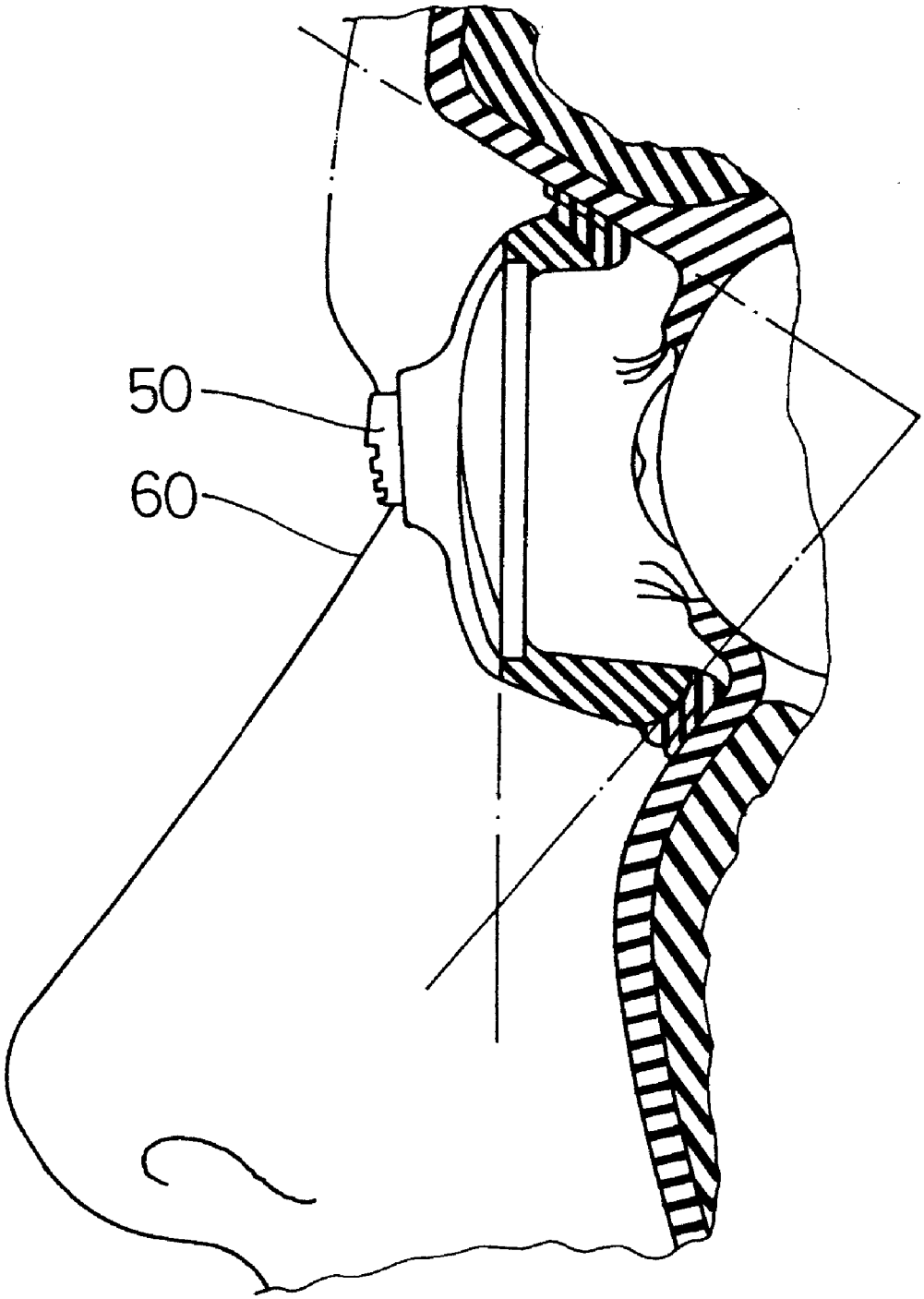
Figure 3:
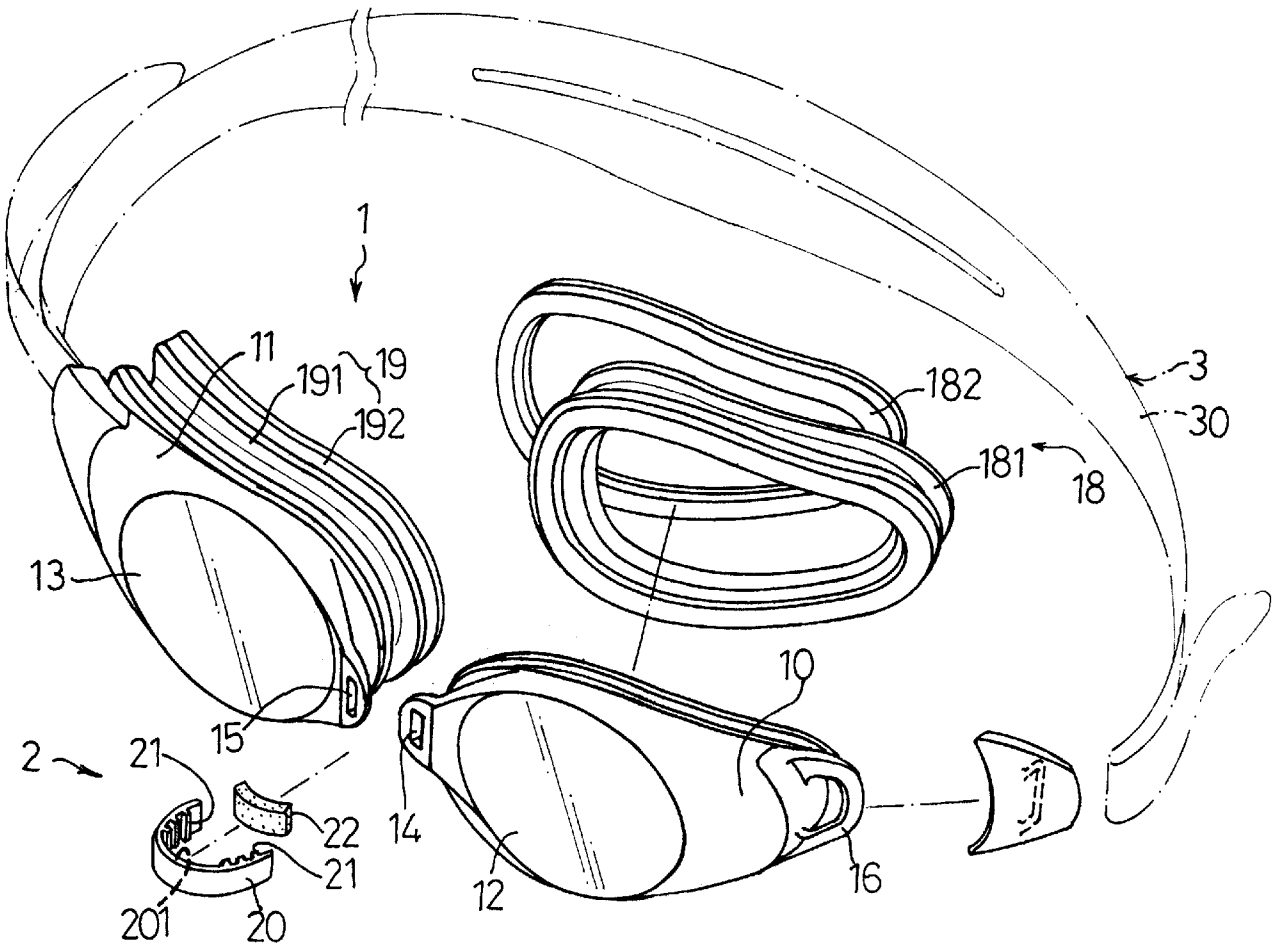
FIG. 3 is an exploded view of the subject invention of swimming goggles.
Figure 4:
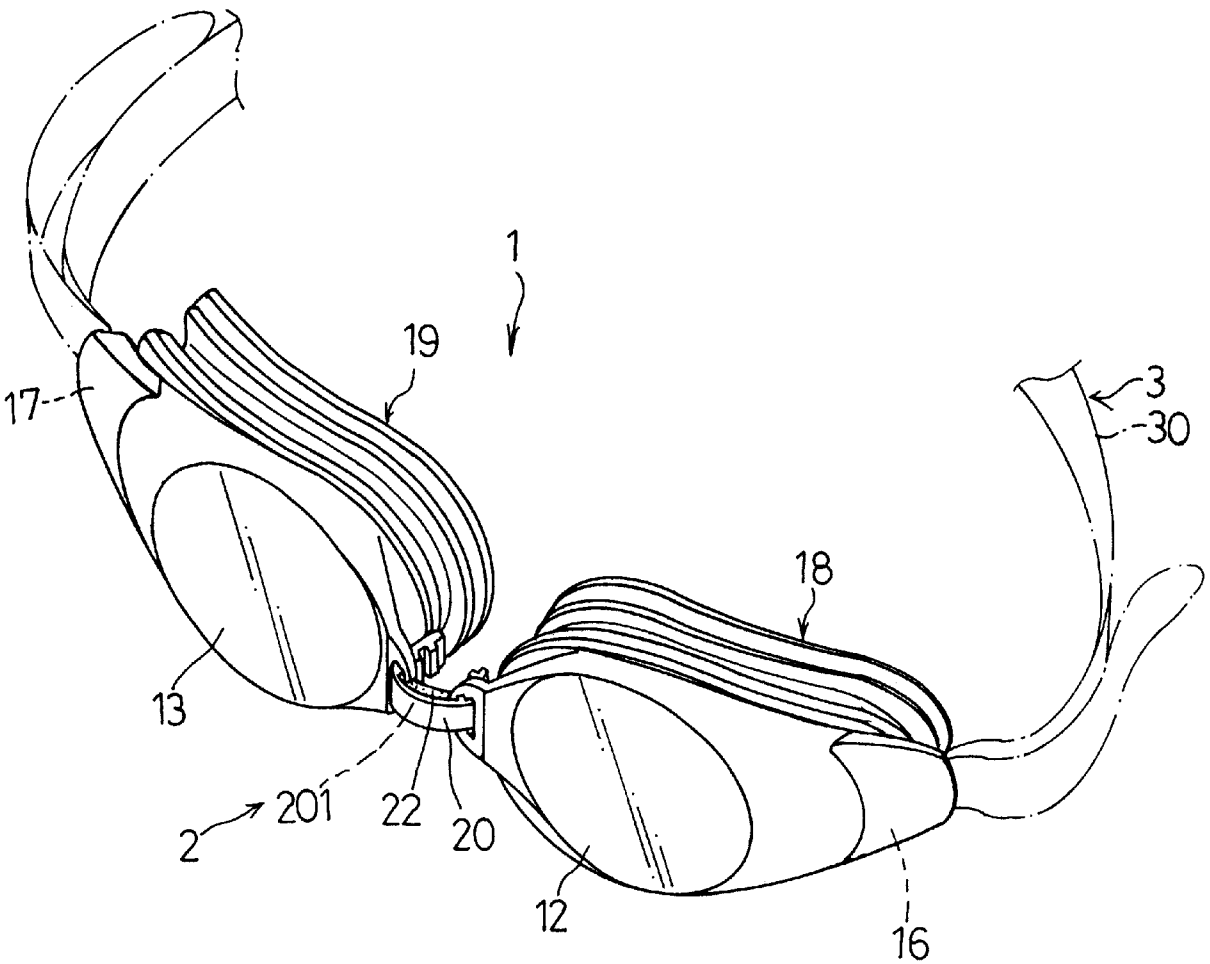
FIG. 4 is an assembled, perspective view of FIG. 3.

Referring to FIGS. 3 and 4, the subject invention of swimming goggles 1 comprises of two frames 10, 11, a nose bridge 2 and a headset 3, of which, each frame 10, 11 is formed as one-piece with tenses 12, 13. On the side of the longer axis are assembling holes 14, 15 and on its outside are joining units 16, 17 to join the headset 3. The joining units, 16, 17, are frame bodies formed as one-piece with the frames 10, 11, enabling penetration and assembly of one end of a headband 30 of the headset 3. On the frames 10, 11, corresponding to one side of the lens 12, 13, are protective pads 18, 19. The said two protective pads, 18, 19, are respectively composed of suction discs, 181, 191, on the frames 10, 11, and sponges, 182, 192, attached to the suction discs—providing a comfortable facefitting effect for the user.

The nose bridge 2 is located between the two frames 10, 11, including a connecting unit 20 and a combining unit 21, of which the connecting unit 20 has two edges. The combining unit 21 has serrated edges on the two ends of the connecting unit 20, whereby these edges can be pulled through the assembling holes 14 and 15 on the frames 10, 11, to combine the two frames 10, 11 as one unit. On the connecting unit 20 is an accommodating groove 201. This groove 201, being a groove body with a shallow center part and two deeper sides, is able to accommodate the sponge 22 by using the gluing process. The sponge, 22, after being assembled, will have more exposure (approximately 1.5 mm), as the middle of the accommodating groove 201 is shallow; meanwhile its two sides will be buried deep in the accommodating groove 201. This is shown in FIG. 4, in which a part of sponge 22 is contained in the accommodating groove 201, while a part is exposed above the accommodating groove 201, so as to provide comfortable contact to the user when the goggles are resting on the nose.

Figure 5:
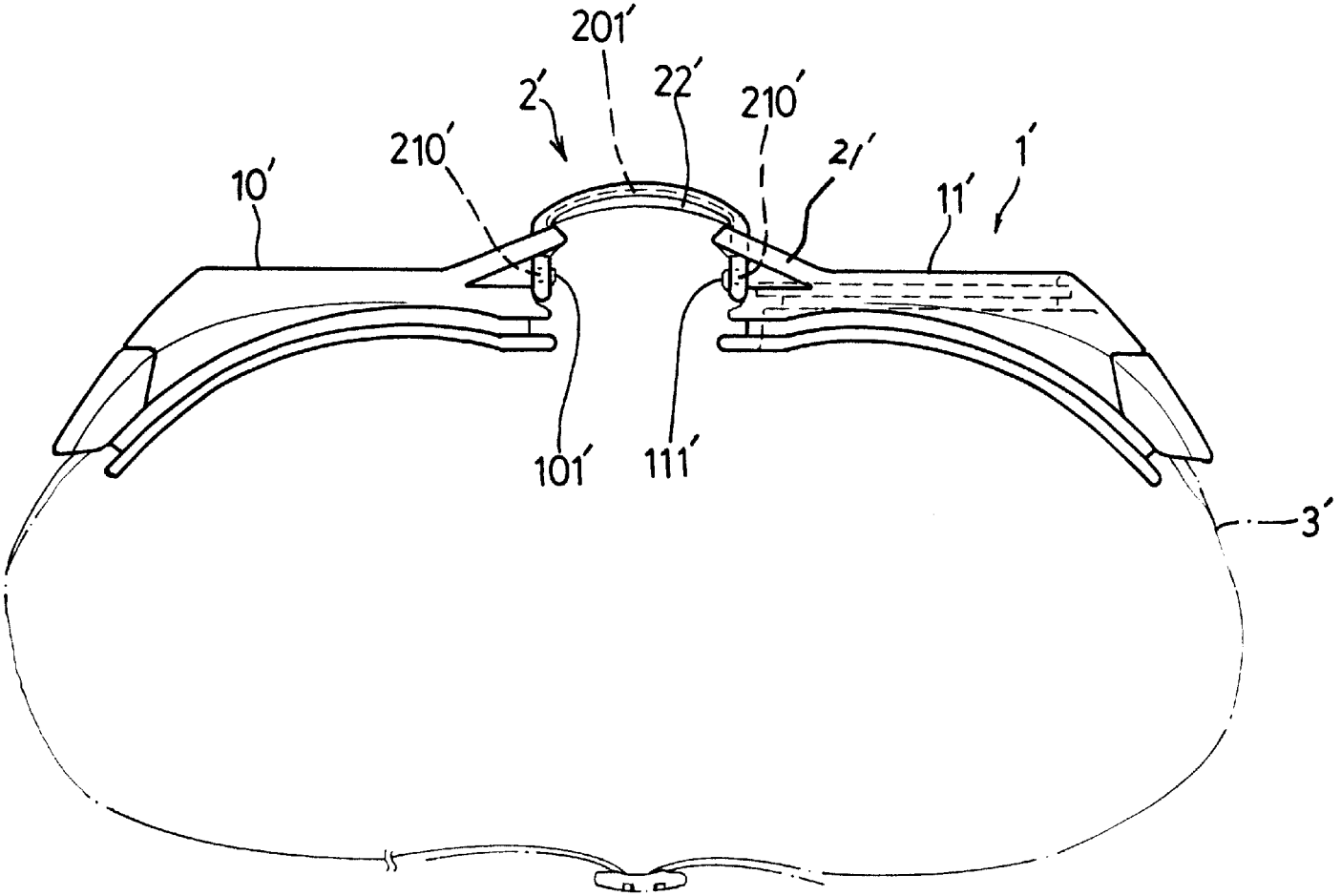
FIG. 5 is a top view of the second embodiment of the invention of swimming goggles.

Referring to FIG. 5, which is a second embodiment of the subject invention of swimming goggles. Whereas the swimming goggles 1 comprises of two frames 10', 11', a nose bridge 2' and a headset 3', the difference between this embodiment and the first embodiment lies in that the combining unit 21' on the nose bridge 2' has extensions roughly perpendicular to the connecting unit 20' at two ends of the connecting unit 20'. Thus, to roughly form a "U" shape, and there being a fixing hole 201' on it, the said fixing hole 201' serves to match the fixing posts 101', 111' on the frames 10', 11'. The sponge 22' on the nose bridge 2', which is the same as in the first embodiment, is installed within the accommodating groove 201', exposing approximately 1.5 mm at its center, for the purpose of comfortably fitting with the nose bridge.

Figure 6:
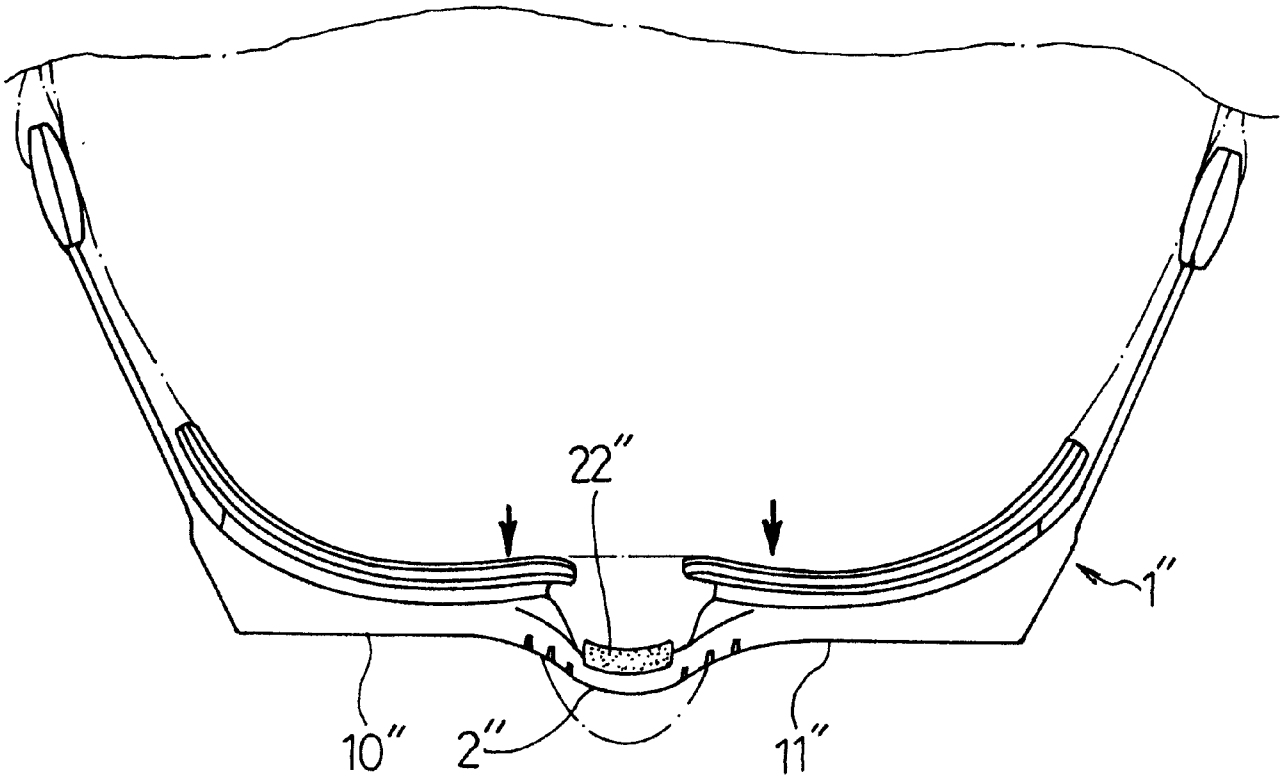
FIG. 6 is a top view of the third embodiment of the invention of swimming goggles.
Figure 7:
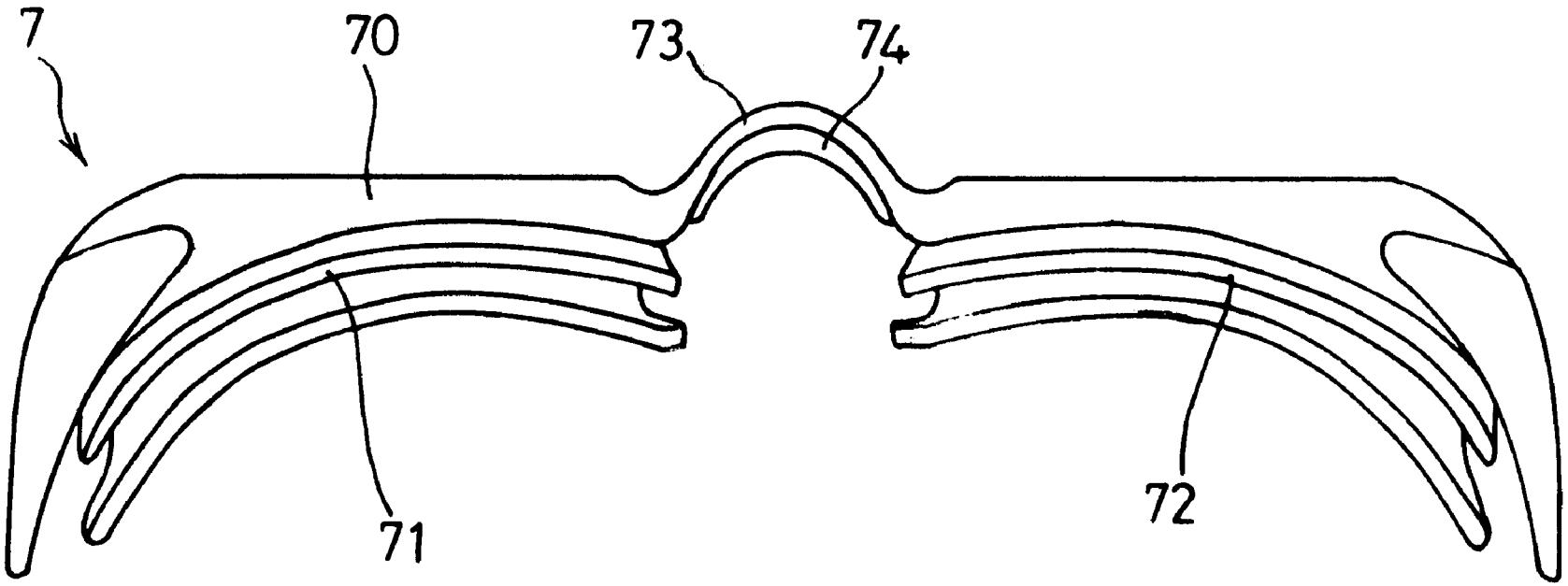
FIG. 7 is a top view of the fourth embodiment of the invention of swimming goggles.

Please refer to FIG. 6 which is a third embodiment of the subject invention. Wherein the swimming goggles 1" are made of one body, comprising of two frames 10", 11", and a nose bridge 2", on the nose bridge 2" there is an accommodating groove 201" to secure the sponge 22" with the gluing process, hence providing comfortable fitting with the nose bridge. FIG. 7 illustrates another type of swimming goggles, these type of swimming goggle 7 has a frame body 70 including a nose bridge 73. The two frames 71, 72 are assembled as one unit, and these type of swimming goggles 7 can also have a sponge 74 fitted onto the nose bridge to provide comfortable fitting with the nose.

Summing up, the subject invention is proven to have a novelty construction and conspicuous performance, as required for the application for a patent right. The above disclosure however, refers merely to the preferred embodiment of the subject invention, which shall not be based to limit or restrict the scope of the subject claims. Therefore, all equivalent variations and modifications deriving from the subject invention shall be included in the spirit and scope of the subject claims.

What is claimed is:

1. Swimming goggles comprising:

two frames, two lenses contained in the two frames, a nose bridge that joins the two frames, and a headset fitted to the outside of the two frames; wherein, said nose bridge includes a connecting unit, a side of the connecting unit adapted to be in contact with a user's nose is covered by soft material, the connecting unit including an accommodating groove to receive the soft material, ends of the accommodating groove being deeper than a central area so that when the soft material is received in the accommodating groove, a center part of the soft material will extend further out of the accommodating groove than do ends of the soft material.

2. The swimming goggles as recited in claim 1, wherein the combining unit has two sets of serrated edges.

3. The swimming goggles as recited in claim 2, wherein the soft material is selected from the group consisting of foam sponge, rubber, plastic and thermoplastic rubber.

4. The swimming goggles as recited in claim 3, wherein the soft material is affixed to the accommodating groove.

5. The swimming goggles as recited in claim 1, wherein the combining unit has extensions generally perpendicular to the connecting unit at two ends of the connecting unit to form a "U" shape body, on which fixing holes to receive the fixing posts on the frames are provided.

6. The swimming goggles as recited in claim 2, wherein the connecting unit is arched.

7. The swimming goggles as recited in claim 6, wherein the soft material is selected from the group consisting of foam sponge, rubber, plastic and thermoplastic rubber.

8. The swimming goggles as recited in claim 7, wherein the soft material is affixed to the accommodating groove.

9. Swimming goggles comprising:

two lens frames, two lenses contained in the two lens frames, a nose bridge that is formed integrally with the two lens frames, and a headset fitted to the outside of the two lens frames; wherein said nose bridge includes a connecting unit, a side of the connecting unit adapted to be in contact with a user's nose is covered by soft material, the connecting unit including an accommodating groove to receive the soft material, ends of the accommodating groove being deeper than a central area so that when the soft material is received in the accommodating groove, a center part of the soft material will extend further out of the accommodating groove than do ends of the soft material.

10. The swimming goggles as recited in claim 9, wherein the soft material is selected from the group consisting of foam sponge, rubber, plastic and thermoplastic rubber.

11. The swimming goggles as recited in claim 10, wherein the soft material is affixed to the accommodating groove.

12. Swimming goggles comprsing:

a nose bridge assembled between two lens frames of the swimming goggles, the nose bridge comprises a connecting unit, a side of the connecting unit adapted to be in contact with a user's nose is covered by soft material, the connecting unit including an accommodating groove to receive the soft material, ends of the accommodating groove being deeper than a central area so that when the soft material is received in the accommodating groove, a center part of the soft material will extend further out of the accommodating groove than do ends of the soft material.

13. The swimming goggles as recited in claim 12, wherein the said soft material is selected from the group consisting of foam sponge, rubber, plastic and thermoplastic material.

14. The swimming goggles as recited in claim 13, wherein the soft material is affixed to the accommodating groove.

* * * * *